United States Patent [19]

Morozumi

[11] Patent Number: 4,763,634

[45] Date of Patent: Aug. 16, 1988

[54] AIR-FUEL RATIO CONTROL SYSTEM FOR AUTOMOTIVE ENGINES

[75] Inventor: Takuro Morozumi, Mitaka, Japan

[73] Assignee: Fuji Jukogyo Kabushiki Kaisha, Tokyo, Japan

[21] Appl. No.: 938,009

[22] Filed: Dec. 4, 1986

[30] Foreign Application Priority Data

Dec. 11, 1985 [JP] Japan ..... 60-280112

[51] Int. Cl.[4] ..... F02M 25/08

[52] U.S. Cl. ..... 123/520

[58] Field of Search ..... 123/440, 489, 519, 520

[56] References Cited

U.S. PATENT DOCUMENTS 3,831,564 8/1974 Schmidt et al. ..... 123/489 X
4,290,400 9/1981 Pomerantz ..... 123/440
4,300,505 11/1981 Takada et al. ..... 123/489 X
4,467,769 8/1984 Matsumura ..... 123/489
4,641,623 2/1987 Hamburg ..... 123/518
4,646,702 3/1987 Matsubara et al. ..... 123/520

FOREIGN PATENT DOCUMENTS 0034439 2/1984 Japan .

*Primary Examiner*—Willis R. Wolfe, Jr.
*Assistant Examiner*—Eric R. Carlberg
*Attorney, Agent, or Firm*—Martin A. Farber

[57] ABSTRACT

An air-fuel ratio control system for an engine has integrating means for integrating an error signal which is the difference between a reference voltage and an output voltage of an $O_2$-sensor and for producing an integration signal. In response to the integration signal, the air-fuel ratio is controlled to a desired value. When fuel vapor in a canister of the engine is purged, an integration constant of the integrating means is increased for a predetermined time in order to allow a deviation of the air-fuel ratio to quickly converge.

4 Claims, 4 Drawing Sheets

AIR-FUEL RATIO CONTROL SYSTEM FOR AUTOMOTIVE ENGINES

BACKGROUND OF THE INVENTION

The present invention relates to a system for controlling air-fuel ratio of an air-fuel mixture for an automotive engine, and more particularly to a system for controlling the air-fuel ratio in accordance with a feedback signal from an $o_2$-sensor for detecting the oxygen concentration of the exhaust gases.

Generally, the engine is provided with a carbon canister for absorbing the fuel vapor in a fuel tank during the time that the engine is not running and for purging the fuel vapor in the canister to an intake manifold under predetermined conditions of the engine operation. When the fuel in the canister is purged, the fuel vapor is added to the air-fuel mixture induced into the cylinders of the engine, rendering the mixture rich.

The air-fuel ratio control system operates to dilute the rich mixture in accordance with the feedback signal of the $O_2$-sensor. However, since the deviation of the air-fuel mixture is large compared with the deviation which may occur in the steady state condition of the engine, it takes a long time to control the deviated air-fuel ratio back to the stoichiometric air-fuel ratio.

Heretofore, there is no control of deviation of the air-fuel ratio during purging of the fuel vapor.

SUMMARY OF THE INVENTION

The object of the present invention is to provide an air-fuel ratio control system which causes the deviation of air-fuel ratio to quickly converge during purging of the fuel vapor in the canister.

In accordance with the present invention, there is provided an air-fuel ratio control system for an automotive engine, the engine having a canister for purging fuel vapor to an intake passage of the engine through a purge valve which has a vacuum operated valve device, and the system having an $O_2$-sensor producing an output voltage relative to oxygen concentration of exhaust gases of the engine, a feedback control system having integrating means for integrating an error signal dependent on the output voltage of the $O_2$-sensor for producing an integration signal and means responsive to the integration signal for controlling air-fuel ratio of mixture supplied to the engine.

The system comprises a solenoid-operated valve having a solenoid and provided in a passage communicating the vacuum-operated valve device with the intake passage, the solenoid-operated valve having ports for selectively communicating the vacuum-operated valve device with an intake manifold of the engine and with the atmosphere, and detecting means for detecting operating conditions of the engine and for producing an engine operation signal when the operating conditions reach a predetermined state. A control unit is responsive to the engine operation signal for operating the solenoid to communicate the vacuum-operated valve device with the intake manifold to open the purge valve, and further responsive to the engine operation signal for increasing a constant of the integrating means for a predetermined time, whereby deviation of the air-fuel ratio can quickly converge.

The other objects and features of this invention will become understood from the following description with reference to the accompanying drawings.

DETAILED DESCRIPTION OF THE PREFERRED EMBODIMENT

Figure 1:
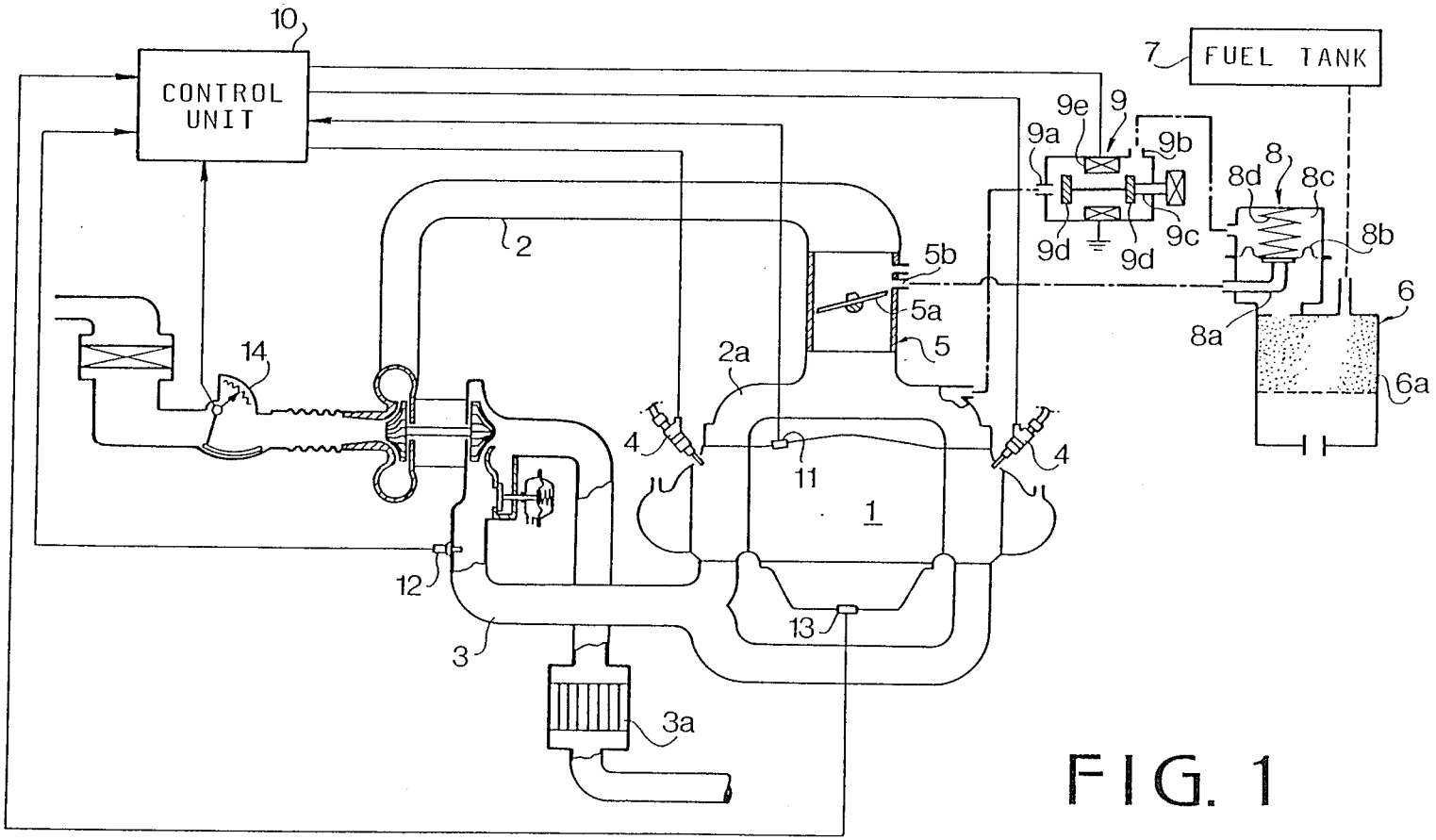
FIG. 1 is a schematic diagram showing a system of the present invention.

Referring to FIG. 1, an automotive engine 1 has an intake pipe 2, a throttle body 5 and an intake manifold 2*a*. An air flow meter 14 is provided in the intake pipe 2. An $O_2$-sensor 12 is provided on an exhaust pipe 3 at a position upstream of a catalytic converter 3*a*. Fuel injectors 4 are mounted on the intake manifold 2*a* and a coolant temperature sensor 11 is mounted on a water jacket of the engine 1. An engine speed sensor 13 is provided for producing an engine speed signal.

A body 6*a* of a carbon canister 6 has a port communicated with a fuel tank 7 and a purge valve 8. The purge valve 8 comprises a pipe 8*a* having an opening at the upper end thereof, a diaphragm 8*b* defining a vacuum chamber 8*c*, and a spring 8*d* urging the diaphragm to the pipe 8*a* to close the opening. The pipe 8*a* is communicated with a port 5*b* provided on the throttle body 5 at a position just above a throttle valve 5*a* in its closed position. The vacuum chamber 8*c* is communicated with the intake manifold 2*a* through a solenoid-operated control valve 9.

The solenoid-operated control valve 9 comprises a port 9*a* communicated with the intake manifold 2*a*, a port 9*b* communicated with the vacuum chamber 8*c*, a pipe 9*c* communicated with the atmosphere, a valve body 9*d* axially slidably provided in the valve housing, and a solenoid 9*e*. When the solenoid 9*e* is excited, the valve body 9*d* is shifted to the left to close the port 9*a* to open the pipe 9*c*, thereby communicating the vacuum chamber 8*c* with the atmosphere. When the solenoid is de-energized, the port 9*a* is opened to communicate the vacuum chamber 8*c* with the intake manifold.

Output signals of the air flow meter 14, sensors 11, 12 and 13 are applied to a control unit 10 which drives the injectors 4 at an injection pulse width dependent on the signals, as described hereinafter in detail.

Figure 2:
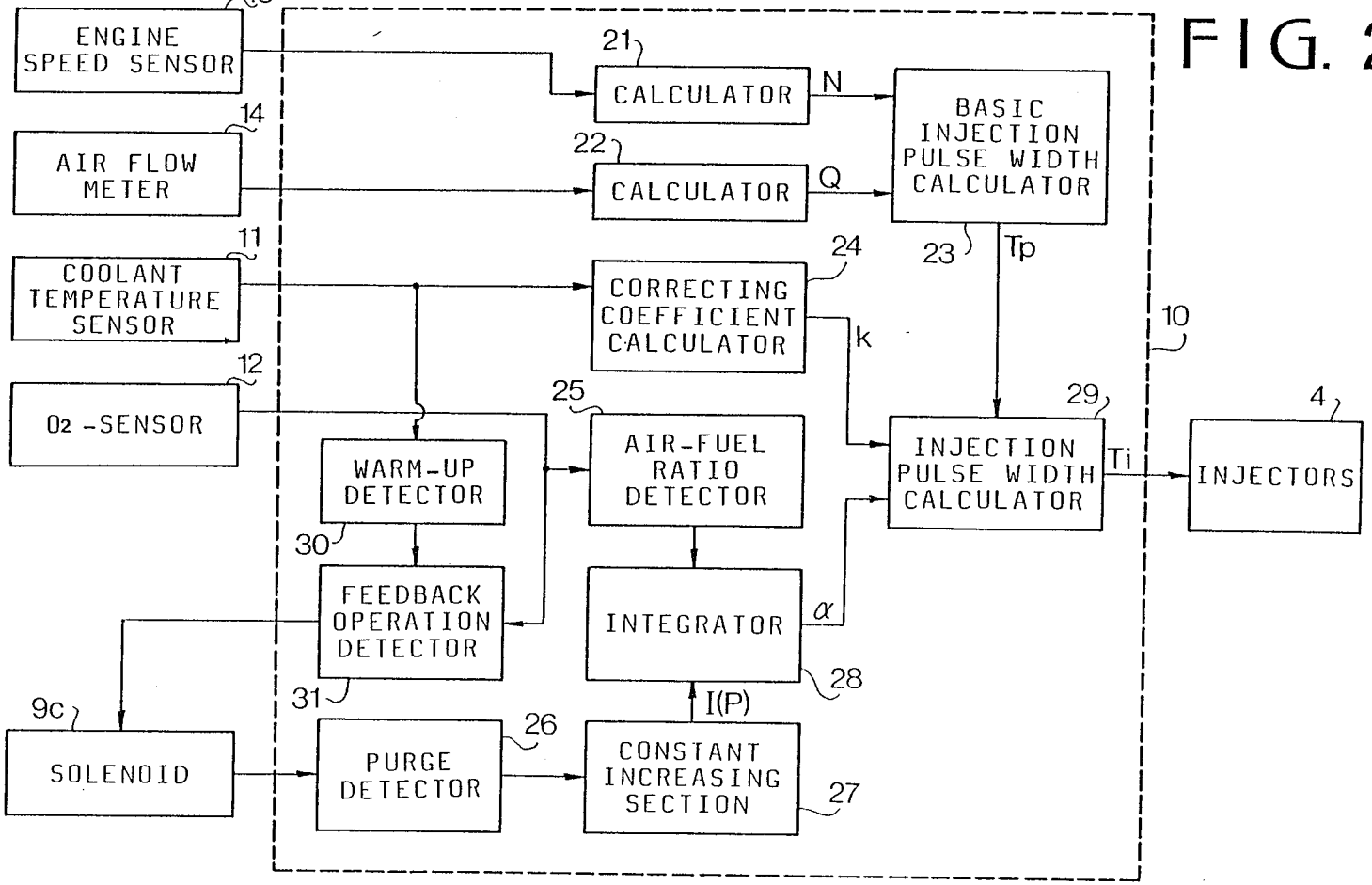
FIG. 2 is a block diagram showing a control unit.

Referring to FIG. 2, output signals of the air flow meter 14 and engine speed sensor 13 are fed to a basic injection pulse width calculator 23 through calculators 21, 22, respectively. The calculator 23 produces a basic injection pulse width signal $T_P$ in dependency on engine speed N and induced amount of air Q. A correcting coefficient calculator 24 is applied with the output signal of the coolant temperature sensor 11 to generate a correcting coefficient signal K for the open loop control. The output signal of the $O_2$-sensor 12 passes to an air-fuel ratio detector 25 which produces an error signal representing the difference between the output voltage of the $O_2$-sensor and a reference voltage. The error signal is applied to an integrator 28. The integrator 28 produces an integration signal $\alpha$ for the closed loop control.

The basic injection pulse width signal $T_P$ and correcting coefficient signal K and integration signal $\alpha$ are applied to an injection pulse width calculator 29 which produces an injection pulse width signal Ti. The signal Ti is fed to the injectors 4 to inject the fuel at the pulse width dependent on the signal Ti.

Figure 3:
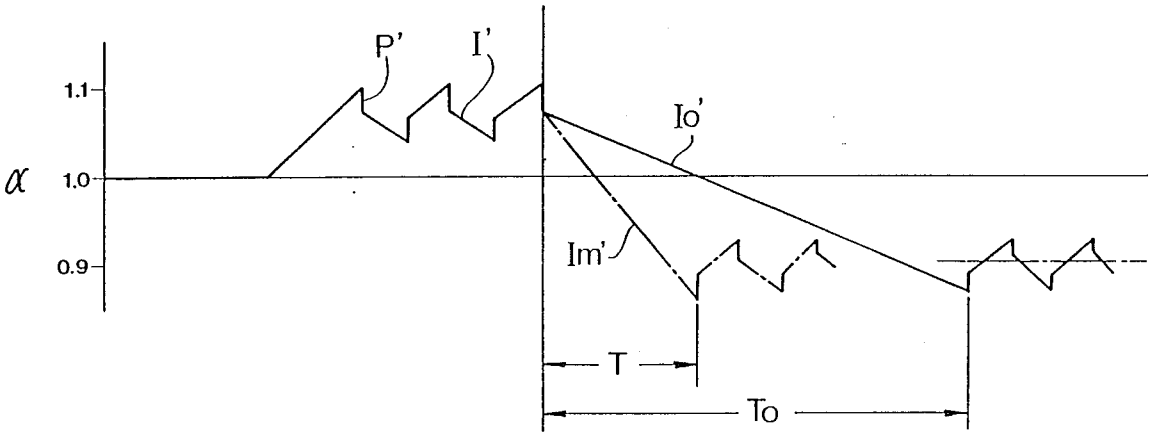
FIG. 3 is a graph showing an output of an integrator in the control unit.

The integrator 28 includes a proportion and integration circuit (PI circuit) having a proportion constant (P) and an integration constant (I), respectively. The PI circuit responds to the output voltage of the air-fuel ratio detector 25 for producing an integration signal $\alpha$ having a proportion component P' and an integration component I' as shown in FIG. 3.

On the other hand, the output signal of the coolant temperature sensor 11 is applied to a warm-up detector 30. The outputs of the sensor 12 and detector 30 are applied to a feedback operation detector 31. When the engine is warmed up and feedback operation starts, the output of the detector 31 causes the solenoid **9*e* de-energize. The signal at the de-energization of the solenoid is fed to a purge detector 26, the output signal of which is in turn applied to a constant increasing section 27. In response to the output signal of the purge detector 26, the section 27 produces a constant increasing signal which is applied to the integrator 28 to increase both the proportion constant P and integration constant I, or either P or I, mainly integration constant I for a predetermined time. Accordingly, the integrator 28** produces an integration signal $\alpha$ having increased components P' and I' for the predetermined time.

Figure 4:
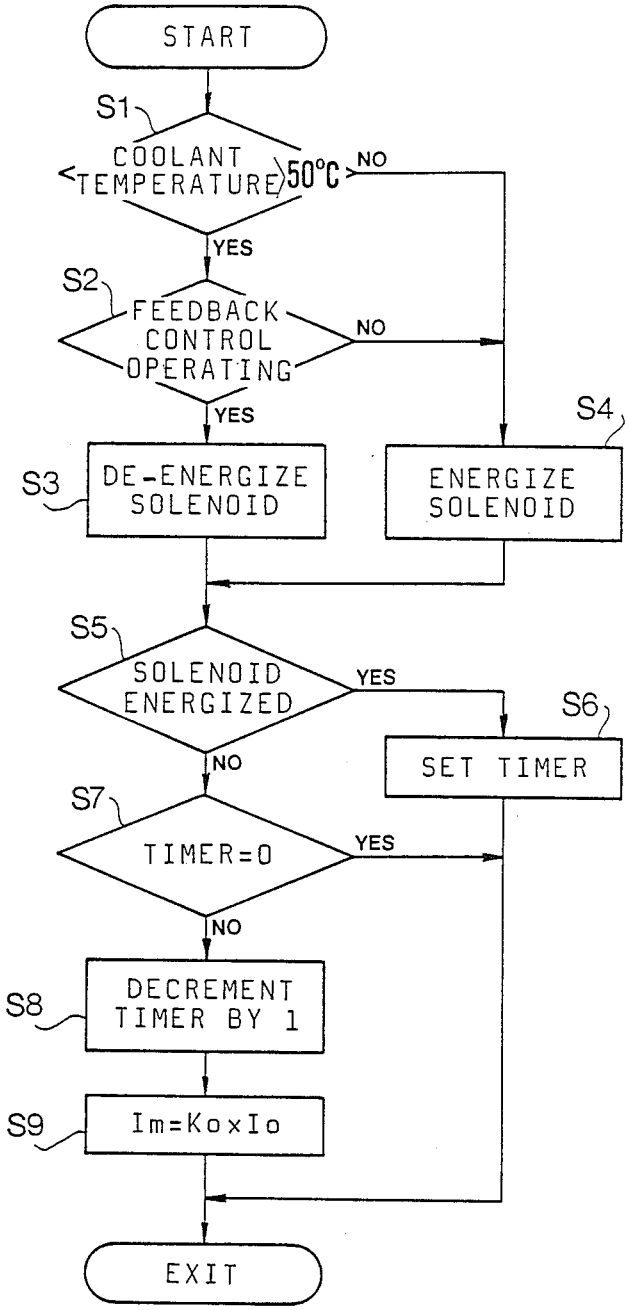
FIG. 4 is a flowchart showing the operation of the system.

The operation of the system is described with reference to FIG. 4. Step S1 determines whether the engine is warmed up, for example whether the coolant temperature is higher then 50° C. When the engine has not yet warmed up, the solenoid **9*c* is energized at step S4. Accordingly, the port 9*a* is closed and port 9*c* is opened, so that the vacuum chamber 8*c* of the purge valve 8 is communicated with the atmosphere, thereby closing the opening of the valve pipe 8*a***.

When the engine is warmed up, the program proceeds to a step S2 where it is determined whether the feedback control system is operating. The determination is dependent on the output voltage of the $O_2$-sensor 12. When the feedback control is effective, the solenoid **9*e* is de-energized at step S3, so that the vacuum chamber 8*c* is communicated with the intake manifold through ports 9*b* and 9*a*. Accordingly, the diaphragm 8*b* is deflected by the intake manifold vacuum to open the opening of the pipe 8*a*, thereby purging the fuel vapor in the canister 6 to the intake manifold. Further, at step S5, when the solenoid is energized, a timer is set to a predetermined time (for example 6 sec.) at step S6. If the solenoid is de-energized, it is determined whether the stored time in the timer is zero at step S7. When the stored time is not zero, the stored time is decremented one by one at step S8, and further, at step S9**, an ordinary integration constant Io is multiplied by a coefficient Ko to produce an increased constant Im. Thus, the integration constant is increased to a predetermined value.

FIG. 3 shows the variation of the integration signal $\alpha$. When the fuel vapor in the canister is purged, the oxygen concentration in the exhaust gases reduces, thereby the signal $\alpha$ decreases. In a conventional system, the integration component I' of the signal $\alpha$ gradually reduces as shown by Io' at the same inclination of the component I'. Accordingly, it takes a long time To to get a desired level. In accordance with the present invention, the integration constant is increased, which means an increase of the inclination of the integration component I', as shown by a line Im'. Thus, the time before the desired level of the signal $\alpha$ is reached is reduced to a time T. In other words, in the system of the present invention, the generation of the corrected signal $\alpha$ is (To−T) faster than the conventional system. Accordingly, the deviation of the air-fuel ratio can quickly converge to the stoichiometric air-fuel ratio.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. In an air-fuel ratio control system for an automotive engine, the engine having a canister for purging fuel vapor to an intake passage of the engine through a purge valve which has a vacuum operated valve device, and the system having an $O_2$-sensor producing an output voltage relative to oxygen concentration of exhaust gases of the engine, a feedback control system having integrating means for integrating an error signal dependent on the output voltage of the $O_2$-sensor for producing an integration signal and means responsive to the integration signal for controlling air-fuel ratio of mixture supplied to the engine, the improvement comprising:

a solenoid operated valve having a solenoid and provided in a passage communicating the vacuum operated valve device with the intake passage, the solenoid operated valve having ports for selectively communicating the vacuum operated valve device with an intake manifold of the engine and with the atmosphere;

detecting means for detecting operating conditions of the engine and for producing an engine operation signal when the operating conditions reach a predetermined state;

control means responsive to the engine operation signal for operating the solenoid to communicate the vacuum operated valve device with the intake manifold to open the purge valve; and means responsive to the engine operation signal for increasing a constant of the integrating means for a predetermined time.

2. The system according to claim 1 wherein the detecting means is means responsive to coolant temperature for producing a signal when the coolant temperature exceeds a predetermined temperature.

3. The system according to claim 1, wherein the constant of the integrating means includes an integration constant.

4. The system according to claim 1, wherein said integrating means includes a proportion means, and wherein the constant includes a proportion constant for amplifying the error signal in accordance with the proportion constant.

* * * * *